United States Patent [19]

Jacobsen et al.

[11] Patent Number: 4,636,267

[45] Date of Patent: Jan. 13, 1987

[54] VACUUM ANNEALING OF ZIRCONIUM BASED ARTICLES

[75] Inventors: William A. Jacobsen, Burrell Township, Indiana County; Richard L. Briggs, Hempfield Township, Westmoreland County, both of Pa.

[73] Assignee: Westinghouse Electric Corp., Pittsburgh, Pa.

[21] Appl. No.: 762,093

[22] Filed: Aug. 2, 1985

[51] Int. Cl.[4] ..... C22F 1/00

[52] U.S. Cl. ..... 148/133; 148/154; 148/155

[58] Field of Search ..... 148/133, 150, 155, 154, 148/210.3, 13, 13.1; 432/11, 12, 18

[56] References Cited

U.S. PATENT DOCUMENTS 4,000,013 12/1976 MacEwen et al. ..... 148/11.5 F

FOREIGN PATENT DOCUMENTS 145767 8/1984 Japan ..... 148/133

*Primary Examiner*—Christopher W. Brody

*Attorney, Agent, or Firm*—R. A. Stoltz

[57] ABSTRACT

A method of more rapidly and uniformly heating bundles of zirconium alloy tubes in a vacuum annealing furnace utilizes an induction coil to preheat the entire bundle as it is being moved into the hot zone of the furnace.

6 Claims, 3 Drawing Figures

VACUUM ANNEALING OF ZIRCONIUM BASED ARTICLES

BACKGROUND OF THE INVENTION

The present invention is concerned with the vacuum annealing of worked reactive metal based articles. It is especially concerned with the use of induction heating in vacuum alpha annealing of cold pilgered zirconium base tubing.

Zircaloy-2 and Zircaloy-4 are commercial alloys, whose main usage is in water reactors such as boiling water (BWR), pressurized water (PWR) and heavy water (HWR) nuclear reactors. Those alloys were selected based on their nuclear properties, mechanical properties and high temperature aqueous corrosion resistance.

The history of the development of Zircaloy-2 and 4 is summarized in: Kass "The Development of the Zircaloys" published in ASTM Special Technical Publication No. 368 (1964) pp. 3–27, and Rickover et al. "History of the Development of Zirconium Alloys for use in Nuclear Reactors", NR: D: 1975. Also of interest with respect to Zircaloy development are U.S. Pat. Nos. 2,772,964; 3,097,094 and 3,148,055.

The commercial reactor grade Zircaloy-2 alloy is an alloy of zirconium comprising about 1.2 to 1.7 weight percent tin, about 0.07 to 0.20 weight percent iron, about 0.05 to 0.15 weight percent chromium and about 0.03 to 0.08 weight percent nickel. The commercial reactor grade Zircaloy-4 allow is an alloy of zirconium comprising 1.2 to 1.7 weight percent tin, about 0.18 to 0.24 weight percent iron, and about 0.07 to 0.13 weight percent chromium. Most reactor grade chemistry specifications for Zircaloy-2 and 4 conform essentially with the requirements published in ASTM B350-80 (for alloy UNS No. R60802 and R60804, respectively). In addition to these requirements the oxygen content for these alloys is typically required to be between 900 and 1600 ppm, but more typically is about 1200±200 ppm for fuel cladding applications. Variations of these alloys are also sometimes used. These variations include a low oxygen content alloy where high ductility is needed (e.g. thin strip for grid applications). Zircaloy alloys having small but finite additions of silicon and/or carbon are also commercially utilized.

It has been a common practice to manufacture Zircaloy (i.e. Zircaloy-2 and 4) cladding tubes by a fabrication process involving: hot working an ingot to an intermediate size billet or log; beta solution treating the billet; machining a hollow billet; high temperature alpha extruding the hollow billet to a hollow cylindrical extrusion; and then reducing the extrusion to substantially final size cladding through a number of cold pilger reduction passes (typically 2 to 5 passes with about 50 to about 85% reduction per pass), having an alpha recrystallization anneal prior to each pass. The cold worked, substantially final size cladding is then final alpha annealed. This final anneal may be a stress relief anneal, partial recrystallization anneal or full recrystallization anneal. The type of final anneal provided is selected based on the designer's specifications for the mechanical properties of the fuel cladding. Examples of these processes are described in detail in WAPD-TM-869 dated 11/79 and WAPD-TM-1289 dated 1/81. Some of the characteristics of Zircaloy fuel cladding tubes are described in Rose et al. "Quality Costs of Zircaloy Cladding Tubes" (Nuclear Fuel Performance published by the British Nuclear Energy Society (1973), pp. 78.1–78.4).

In the foregoing conventional methods of tubing fabrication the alpha recrystallization anneals performed between cold pilger passes and the final alpha anneal have been typically performed in large vacuum furnaces in which a large lot of intermediate or final size tubing could be annealed together. Typically the temperatures employed for these batch vacuum anneals of cold pilgered Zircaloy tubing have been as follows: about 450° to about 500° C. for stress relief annealing without significant recrystallization; about 500° C. to about 530° C. for partial recrystallization annealing; and about 530° C. to about 760° C. (however, on occasion alpha, full recrystallization anneals as high as about 790° C. have been performed) for full alpha recrystallization annealing. These temperatures may vary somewhat with the degree of cold work and the exact composition of the Zircaloy being treated. During the foregoing batch vacuum alpha anneals it is typically desired that the entire furnace load be at the selected temperatures for about one to about 4 hours, or more, after which the annealed tubes are vacuum or argon cooled.

The nature of the foregoing batch vacuum alpha anneals creates a problem which has not been adequately addresed by the prior art. This problem relates to the poor heat transfer conditions inherent in these batch vacuum annealing procedures which may cause the outer tubes in a large bundle to reach the selected annealing temperature within about an hour or two, while tubes located in the center of the bundle, after 7 to 10 hours (at a time when the anneal should be complete and cooling begun) have either not reached temperature, are just reaching temperature, or have been at temperature for half an hour or less. These differences in the actual annealing cycle that individual tubes within a lot experience can create a significant variation in the tube-to-tube properties of the resulting fuel cladding tubes. This variability in properties is most significant for tubes receiving a stress relief anneal for a partial recrystallization anneal, and is expected to be reduced by using a full recrystallization anneal. Where the fuel cladding design requires the properties of a stress relieved or partially recrystallized microstructure, a full recrystallization final anneal is not a viable option. In these cases extending the vacuum annealing cycle is one option that has been proposed, but is expensive in that it adds time and energy to an already long heat treatment which may already be taking on the order of 16 hours from the start of heating of the tube load to the completion of cooling.

Additional examples of the conventional Zircaloy tubing fabrication techniques, as well as variations thereon, are described in the following documents: "Properties of Zircaloy-4 Tubing" WAPD-TM-585; Edstrom et al. U.S. Pat. No. 3,487,675; Matinlassi U.S. Pat. No. 4,233,834; Naylor U.S. Pat. No. 4,090,386; Hofvenstam et al. U.S. Pat. No. 3,865,635; Andersson et al. "Beta Quenching of Zircaloy Cladding Tubes in Intermediate or Final Size," *Zirconium in the Nuclear Industry: Fifth Conference, ASTM STP*754 (1982) pp. 75–95.; McDonald et al. U.S. patent application Ser. No. 571,122 (a continuation of Ser. No. 343,787, filed Jan. 29, 1982 now abandoned and assigned to the Westinghouse Electric Company); Sabol et al. U.S. patent application Ser. No. 571,123 (a continuation of Ser. No. 343,788, filed Jan. 29, 1982, now abandoned and assigned to the Westinghouse Electric Corporation); Armijo et al. U.S. Pat. No. 4,372,817; Rosenbaum et al. U.S. Pat. No. 4,390,497; Vesterlund et al. U.S. Pat. No. 4,450,016; Vesterlund U.S. Pat. No. 4,450,020; and Vesterlund French Patent Application Publication No. 2,509,510 published Jan. 14, 1983.

SUMMARY OF THE INVENTION

In accordance with our invention, the prior art problems relating to nonuniform heating in batch vacuum furnaces can be substantially alleviated by heating the bundle of zirconium alloy tubes with an induction coil as they are moved from the cold zone to the hot zone of the vacuum furnace. In this manner the center of the bundle will have reached a temperature of between about 500° F. and the desired annealing temperature as the bundle enters the hot zone. Thusly, time for heating will be significantly reduced and tubes at the center and the periphery of the bundle will receive substantially the same time-temperature cycling during the annealing heat treatment.

These and other aspects of the present invention will become more apparent upon review of the drawings, briefly described below, in conjunction with the detailed description of the invention.

DETAILED DESCRIPTION OF THE INVENTION

Figure 1:
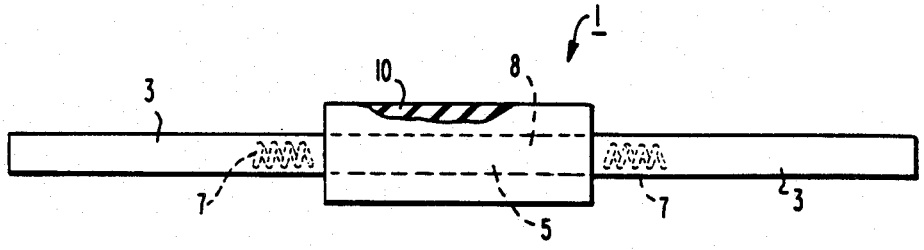
FIG. 1 schematically shows the outline of an embodiment of vacuum furnace to be utilized in accordance with the present invention.

In accordance with our invention, a hot wall vacuum furnace 1 is shown in FIG. 1. The furnace includes two cold zones 3 and a hot zone 5. Bundles of tubes may be placed in the furnace or retrieved from the furnace through either cold zone 3. Located near the end of one or both cold zones 3 closest to hot zone 5 is a large induction coil 7 having an inside diameter sufficient to allow a bundle of tubes, and the basket holding the tubes, to pass through the coil as a unit. This is more clearly shown in FIGS. 2 and 3. The hot zone includes a vacuum chamber 8 which is surrounded by electrical resistance heating elements and thermal insulation 10.

Figure 3:
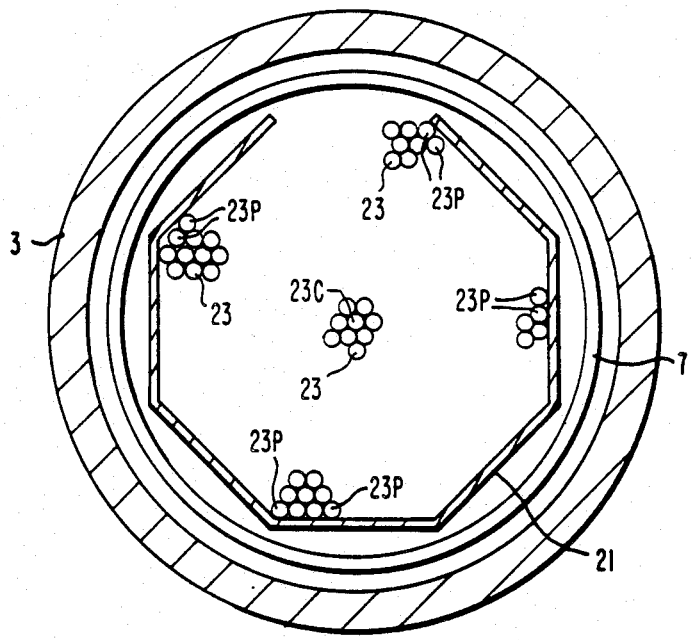
FIG. 3 shows a transverse cross-section through a tube bundle and the cold zone of the furnace shown in FIGS. 1 and 2 as the tube bundle is scanned by an induction coil in accordance with the present invention.
Figure 2:
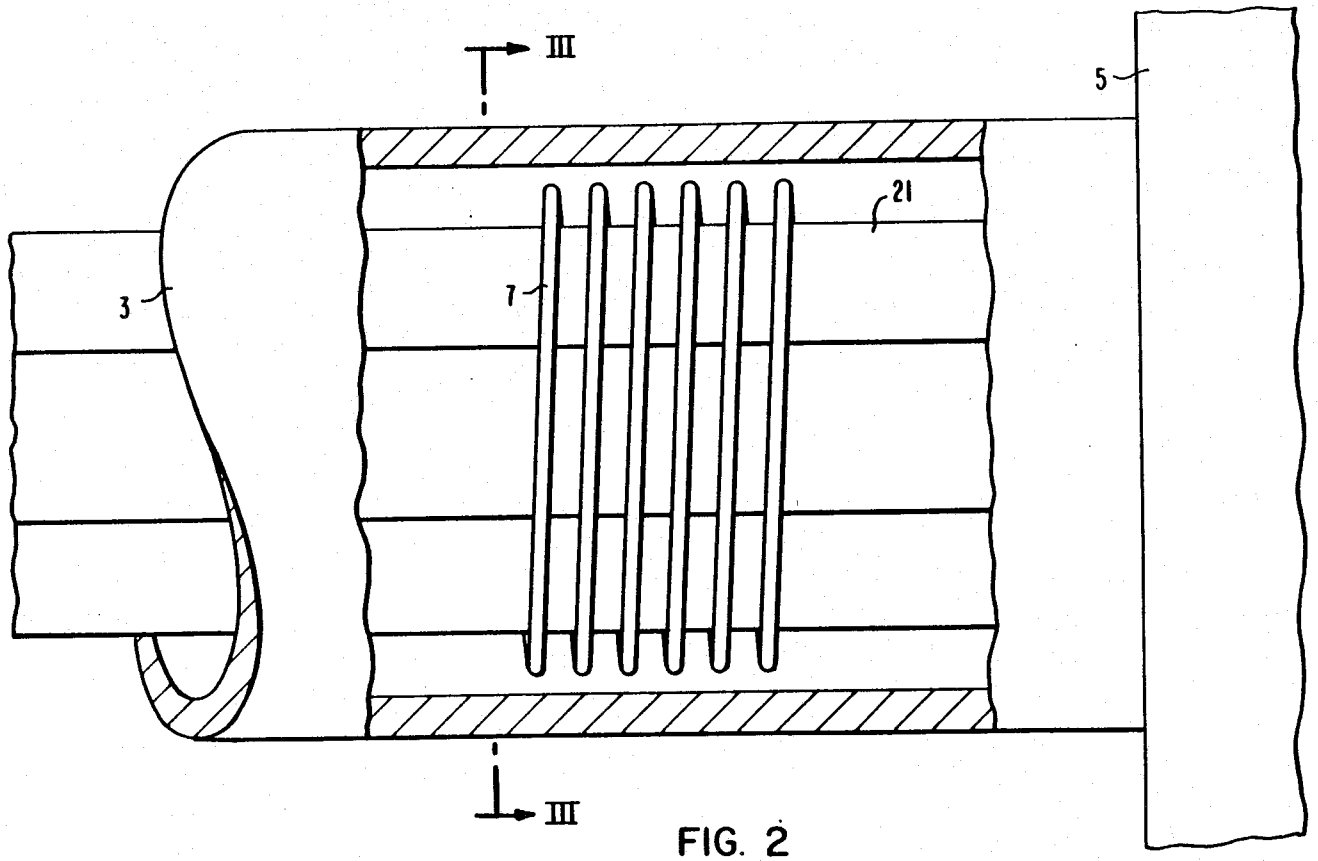
FIG. 2 shows an embodiment of a process in accordance with the present invention.

As shown in FIGS. 2 and 3, in accordance with our invention, a basket 21 holding cold pilgered Zircaloy tubes 23 is first pushed into one of the cold zones 3. The tubes are arranged in close packed arrangement as shown in FIG. 3 and fill the basket 21. The basket 21 is preferably long enough to hold two bundles of tubes in end to relation to each other. Each bundle may contain on the order of 600 tubes each having a nominal diameter of about $\frac{3}{8}$ inch, for example, and a thin wall thickness typical of nuclear fuel cladding. The tubes have a length in excess of about 10 feet and are preferably either Zircaloy-2 or Zircaloy-4. The cold zone 3 containing the basket of tubes is then sealed and evacuated. The hot zone 5 is maintained at a temperature between about 820° and about 1450° F., and more preferably about 870° to about 1250° F. The exact temperature selected is determined by whether a stress relieved, partially recrystallized, or fully recrystallized microstructure is desired. After evacuation is complete and the hot zone is at the desired temperature a gate value between the hot and cold zones is opened and the basket 21 of tubes 23 is pushed through the energized induction coil 7. As the basket of tubes passes through the induction coil the tubes are inductively heated such that the entire cross-section of the bundle is heated to as near the desired annealing temperature as possible without exceeding the desired annealing temperature by more than 50° F. In practice, it is preferred that the central tube 23C or tubes, in the bundle attain at least 500° F. as they exit the induction coil 7, while the peripheral tubes 23P in the bundle are at a higher temperature which is still less than 50° F. above the desired annealing temperature. Preferably the temperature of the peripheral tubes does not exceed the desired annealing temperature.

As the tubes move through the coils 7 the hot end of the tubes moves into the hot zone 5. When the entire tube bundle has passed through the energized coil and is in the hot zone 5 of the furnace 1 the gate valve between the hot zone and cold zone is closed and power to the coil is turned off.

Since the bundle has been preheated by the coil the heat up time in the hot zone is significantly reduced and the center tubes 23C come up to the hot zone temperature within 2 to 3 hours, or less. In this manner, the difference in soak time seen by the tubes on the periphery of the bundle compared to the tubes in the center of the bundle has been reduced compared to prior art vacuum annealing practice. Upon completion of the anneal the gate value to cold zone 3 is opened and the tube bundle and basket are moved into the evacuated cold zone to cool prior to removal from the furnace.

While the annealed tube bundle is cooling, a second tube bundle in the other cold zone is being moved through an energized coil 7 on that side of the furnace and then into the hot zone.

In this manner, the process can be alternately repeated from each side of the hot zone without the need to cool the hot zone.

In an alternative embodiment, the cold zone 3 into which the hot tubes are pushed for cooling, may be flooded with an inert gas, such as argon, to speed up cooling.

The preceding examples have clearly demonstrated the benefits obtainable through the practice of the present invention. Other embodiments of the invention will become more apparent to those skilled in the art from a consideration of the specification or actual practice of the invention disclosed herein. It is intended that the specification and examples be considered as exemplary only, with the true scope and spirit of the invention being indicated by the following claims. All of the documents previously cited herein are hereby incorporated by reference.

We claim:

1. A method of annealing comprising the steps of:

obtaining a bundle of zirconium base alloy tubes;

placing said bundle into the cold zone of a vacuum furnace;

evacuating said cold zone and maintaining a hot zone to said furnace at a desired annealing temperature between about 820° and about 1450° F.;

moving said bundle through an energized induction coil and into the hot zone of said furnace;

heating said bundle with said energized induction coil as said bundle moves through said energized induction coil, and whereby a central tube in said bundle is heated to a temperature between about 500° F. and said desired annealing temperature, while the tubes on the periphery of said bundle are heated to a maximum temperature which is less than 50° F. above the desired annealing temperature.

2. The method according to claim 1 further comprising the steps of:

holding said bundle within said hot zone for a predetermined period of time to provide a predetermined metallurgical structure.

3. The method according to claim 1 further comprising the step of:

removing said bundle from said hot zone and cooling said bundle at room temperature.

4. The method according to claim 1 further comprising the step of removing said bundle from said hot zone and cooling said bundle to room temperature.

5. The method according to claim 1 wherein said desired annealing temperature is between about 870° and about 1250° F.

6. The method according to claim 1 wherein said maximum temperature is equal to, or less than said desired annealing temperature.

* * * * *